United States Patent [19]

Moranne

[11] Patent Number: 4,582,127

[45] Date of Patent: Apr. 15, 1986

[54] TUBE END PLATE FOR HEAT EXCHANGER WITH TUBES AND WATER BOXES

[75] Inventor: Jean-Pierre Moranne, Saint-Leu-la-Foret, France

[73] Assignee: Societe Anonyme des Usines Chausson, Asnieres, France

[21] Appl. No.: 562,220

[22] Filed: Dec. 16, 1983

[30] Foreign Application Priority Data

Dec. 22, 1982 [FR] France ..... 82 21561

[51] Int. Cl.[4] ..... F28F 9/02

[52] U.S. Cl. ..... 165/83; 165/173

[58] Field of Search ..... 165/173, 175, 176, 178, 165/149, 83

[56] References Cited

U.S. PATENT DOCUMENTS 352,378 11/1886 Warden ..... 165/83
352,380 11/1886 Warden ..... 165/83 X
4,234,041 11/1980 Melnyk ..... 165/173
4,305,459 12/1981 Nonnenmann et al. ..... 165/173
4,485,867 12/1984 Melnyk et al. ..... 165/173

FOREIGN PATENT DOCUMENTS 2222623 3/1973 France ..... 165/176
699032 10/1953 United Kingdom ..... 165/173

*Primary Examiner*—Albert W. Davis, Jr.
*Assistant Examiner*—Peggy A. Neils
*Attorney, Agent, or Firm*—Browdy and Neimark

[57] ABSTRACT

The tube end plate for a heat exchanger having tubes engaged into collars of the tube end plate which is covered by a water box is provided with a peripheral groove cooperating with a lower portion of the water box to which it is rigidly connected for forming therewith a hollow beam. There is provided a bottom portion of tube end plate in which are made tube passages defined by collars to which are brazed the tubes and between which are provided transverse slots.

7 Claims, 7 Drawing Figures

TUBE END PLATE FOR HEAT EXCHANGER WITH TUBES AND WATER BOXES

BACKGROUND OF THE INVENTION

The present invention relates to a new type of tube end plates for heat exchanger of the tube and heat dissipator type, such as cooling radiators for vehicle engines. The invention applies more particularly to radiators for heavy duty trucks; due to their large size, the heat expansions reach a particularly great amplitude. However a strong connection is provided between the water boxes and side flanges, in order to form a rigid frame which therefore does not permit heat expansions, such a strong connection being provided for improving the mechanical resistance of such heavy duty heat exchangers subjected in operation to severe conditions and for which there is required a particularly long life time.

Within the scope of the invention, there is also proposed to obtain a tube end plate which can be used for providing heat exchangers with several passes, i.e. in which the liquid to be cooled flows in a same direction or on the contrary along one or several hair-pin bends.

SUMMARY OF THE INVENTION

The tube end plate for heat exchanger according to the invention has on a peripheral groove cooperating with lower portion of the water box forming a hollow beam and to which it is connected by means known in the heat exchanger art and providing a longitudinal rigidity of the tube end plate in a complementary manner to that provided by the hollow beam-shaped water box. A bottom portion of the tube end plate is provided with tube passages having collars to which the tubes are brazed and between which are formed transverse slots extending transversely up to an inner wall defining the peripheral groove and by which the tube end plates can accommodate differential heat expansions generating detrimental stresses which should not appear in the brazed seals.

BRIEF DESCRIPTION OF THE DRAWINGS

Various features of the invention will become more apparent from the following description with reference to the accompanying drawings of an embodiment consisting, in a non limitating manner, of a tube end plate for a heat exchanger crimped onto a water box via a flexible gasket; in the drawings.

DESCRIPTION OF THE PREFERRED EMBODIMENT

Figure 1:
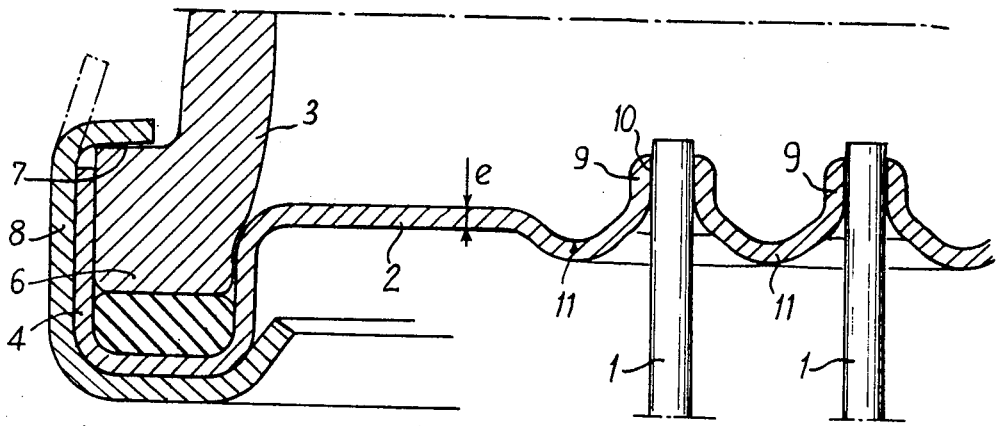
FIG. 1 is a partial sectional view of a heat exchanger comprising a tube end plate according to the invention.

FIG. 1 shows in part a heat exchanger comprising circulation tubes 1, a tube end plate 2 and a water box 3 covering the tube end plate 2. The tube end plate 2 is shaped in a known manner for defining at its periphery a groove 4 receiving a deformable gasket 5, for example made of an elastomer. The gasket 5 is squeezed in the bottom of the groove 4 by a lower edge 6 of the water box 3, said edge being formed on its top portion with a heel 7 onto which is folded a clamp 8.

The tube end plate 2 is configurated, for example stamped, so as to have collars 9 in one or several rows, the collars each defining a tube passage 10 in which the end of a tube 1 is provided to be engaged.

As shown in the drawings, slots 11 are formed transversely in the tube end plate between each collar 9 or row of collars.

Figure 2:
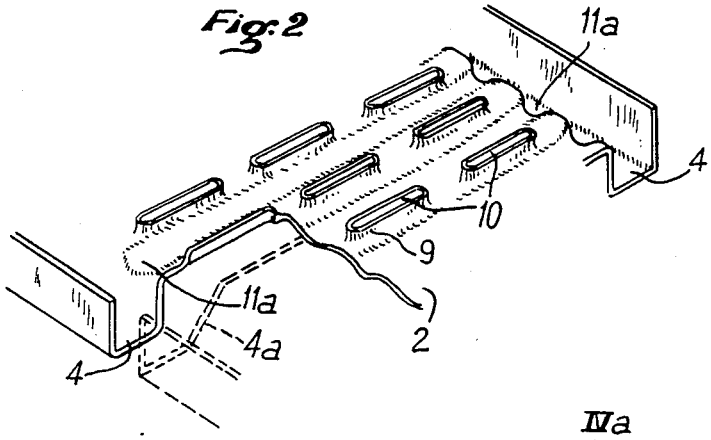
FIG. 2 is a partial perspective view showing the inside of the tube end plate.
Figure 3:
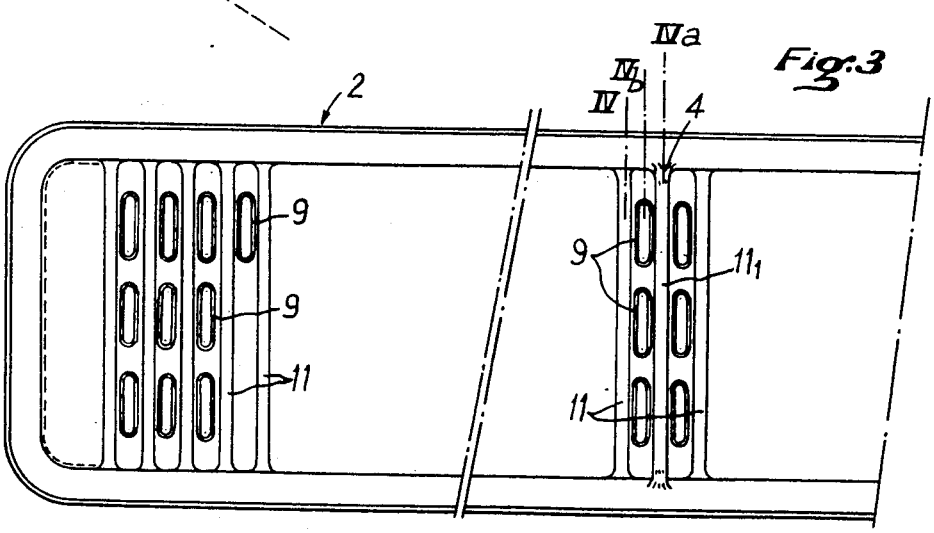
FIG. 3 is a partial plan view, as seen from above of the tube end plate.
Figure 4:
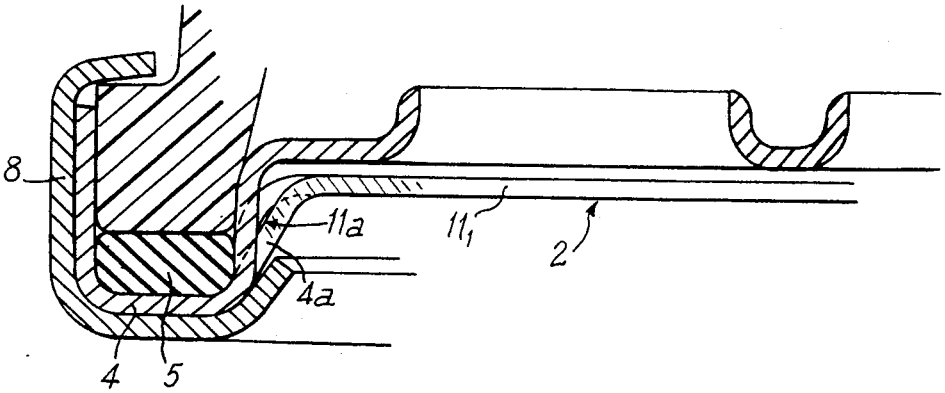
FIG. 4 is a superposition of sectional views taken along lines IV, IVa and IVb of FIG. 3.

As shown in the drawings, in the perspective view of FIG. 2 and in that of the sectional views of FIG. 4 which is taken along line IV of FIG. 3, the slots are formed up to the inner wall defining the groove 4 and terminate in a rounded portion 11*a*. The drawings show also that the slots 11 have their concavity turned toward the inside of the tube end plate, i.e. toward the water box 3.

Depth of the slots 11 is chosen to be preferably greater than thickness e of the tube end plate, but less than double of the thickness e. The hereabove slots 11 form so to speak an embossing between each tube 1 or row of tubes, thereby providing the tube end plate with a flexibility making possible a deformation between the tubes 1 or rows of consecutive tubes while providing on the other hand a rigidification of the tube end plate adjacent its portion defining the shaped groove 4. Thus, the portion of the tube end plate 2 defining the collars 9 can be subjected to deformations of small amplitude due to differential heat expansions between the tubes without these deformations being transmitted to the portion defining the groove 4 which, on the contrary, is made rigid by the rounded end of the slots. Thus, the groove 4 is formed in a rigid frame such that the gasket 5 can be kept under a uniform pressure by the clamp 8, whatever are the operating conditions of the heat exchanger.

Figure 5:
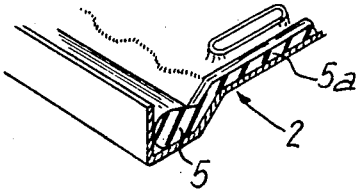
FIG. 5 is a partial perspective view of the tube end plate cut along line IVb of FIG. 3 and provided with a sealing gasket.
Figure 6:
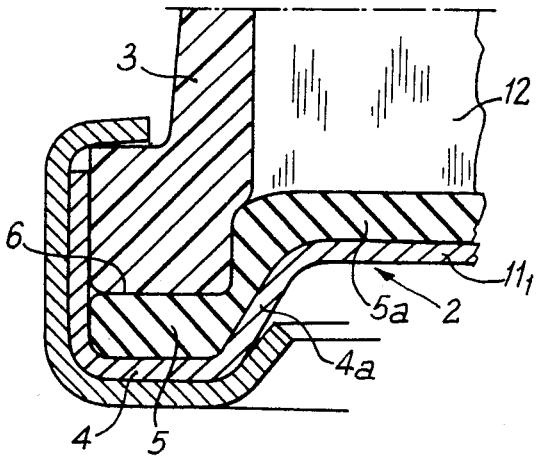
FIG. 6 is a partial sectional view also seen along line IVb of FIG. 3 and showing aspect of the gasket when a water box is in position on the tube end plate.

As shown in the drawings, it is advantageous that at least one of the slots, such as that shown at $\mathbf{11}_1$, be formed so as to open on a wall portion 4*a* of the groove 4 which is not provided with the rounded portion 11*a* but has on the contrary a steeper inclination, for example of 60° with respect to horizontal. The slot $\mathbf{11}_1$ is provided, in the embodiment shown, for housing a wall gasket 5*a* (FIGS. 5, 6 and 7) for providing tightness between a wall 12 formed inwardly by the water box 3 and the tube end plate 2 when the heat exchanger is of the several pass type. More generally, the slot 11 cooperates with a wall separating two compartments of the water box.

Figure 7:
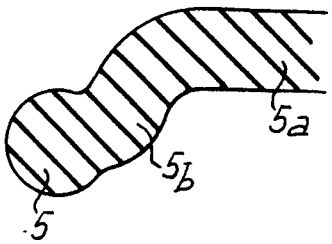
FIG. 7 is a partial sectional view of the gasket shown in FIG. 6 when the gasket is not compressed.

As shown in FIG. 7, it is advantageous that the wall gasket 5*a* is formed integrally with the gasket 5 and has a swelling portion 5*b* (FIG. 7) corresponding to the slanting edge 4*a* which is prolongating the slot $\mathbf{11}_1$ on each side thereof.

The effect of such a configuration is that the underneath portion 6 of the water box strongly deforms the gasket at the swelling portion 5*b* and thereby applies it very closely against the lower portion of the water box as well as against the bottom of the slot $11_1$ and against the slanting wall 4*a*.

What is claimed is:

1. A tube end plate for a heat exchanger having tubes engaged into collars of the tube end plate which is covered by a water box, the tube end plate having a peripheral groove cooperating with a lower portion of the water box to which it is rigidly connected for forming therewith a hollow beam, and wherein there is provided a bottom portion of the tube end plate in which are made tube passages defined by collars to which are brazed the tubes and between which are provided transverse slots extending transversely up to an inner wall defining the peripheral groove, the transverse slots accommodating thermally-caused deformations of the tube end plate between adjacent tubes whereby flexibility of the tube end plate is insured.

2. A tube end plate according to claim 1, wherein the transverse slots terminate in a rounded portion.

3. A tube end plate according to claim 1, wherein at least one of the transverse slots extends up to slanting edges leading to bottom of the peripherical groove for supporting a transverse gasket connected to a peripheral gasket positioned in the groove.

4. A tube end plate according to claim 3, wherein the slanting edges form an angle of about 60° with horizontal.

5. A tube end plate according to claim 1, wherein the transverse slots have a depth greater than a thickness of the tube end plate and less than double of said thickness.

6. A tube end plate according to claim 3, wherein the peripheral gasket is integral with at least one transverse wall gasket corresponding to each slot opening at the slanting edges, said wall gaskets having a swelling portion when in their rest condition, said swelling portion extending substantially opposite each slanting edge.

7. A tube end plate according to claim 1, wherein the tube passages are defined by protruding collars.

* * * * *